United States Patent [19]

Henson et al.

[11] Patent Number: 4,759,404

[45] Date of Patent: Jul. 26, 1988

[54] HETERODENSITY HEAT TRANSFER APPARATUS AND METHOD

[76] Inventors: H. Keith Henson, 1620 N. Park Ave., Tucson, Ariz. 85719; K. Eric Drexler, 518 Putnam Ave., #9, Cambridge, Mass. 02139

[21] Appl. No.: 859,458

[22] Filed: May 5, 1986

Related U.S. Application Data

[62] Division of Ser. No. 150,703, May 19, 1980, abandoned.

[51] Int. Cl.[4] ..... F28D 15/00

[52] U.S. Cl. ..... 165/104.13; 165/104.34

[58] Field of Search ..... 165/104.13, 104.34; 126/900

[56] References Cited

U.S. PATENT DOCUMENTS 2,690,051 9/1954 Peskin ..... 165/104.13
3,908,632 9/1975 Poulsen ..... 126/900
4,313,304 2/1982 Hunt ..... 126/900
4,333,445 6/1982 Lee ..... 126/900

*Primary Examiner*—Albert W. Davis, Jr.
*Attorney, Agent, or Firm*—Dula, Shields & Egbert

[57] ABSTRACT

An apparatus for use in a microgravity environment for radiating waste heat using a multiphase mixture of gas and solid particles or dust as a heterodensity heat transfer medium. A conventional heat exchanger is in thermal contact with the heterodensity heat transfer medium, whereby the heat is imparted to the gas and the particles, whereupon the gas and particles are moved to a thin plate emission type radiator which absorbs heat from the particles and gas and radiates said heat into space. The heterodensity heat transfer's medium may be mobilized by modified centrifugal blowers throughout the system. A portion of the heterodensity medium may emit ionizing radiation to prevent the build-up of static charges in the solid phase of the heterodensity medium.

12 Claims, 2 Drawing Sheets

HETERODENSITY HEAT TRANSFER APPARATUS AND METHOD

BACKGROUND OF THE INVENTION

This is a divisional of co-pending Ser. No. 150,703 filed on May 19, 1980, now abandoned.

1. Field of the Invention

The present invention relates generally to heat transfer apparatus and methods. More specifically, the present invention relates to a method and apparatus for using a multiphase heterodensity heat transfer medium in a microgravity environment, i.e. as in outer space.

2. Background Art

A hitherto unsolved problem common to both space habitats, space industries, and thermal cycle power satellites is finding an economical way to dispose of immense amounts of waste heat. The most common source of energy for habitats are sunlight collectors. Since most of this sunlight is eventually degraded to heat and because of the thermodynamics of radiators, the structures required to dispose of this waste heat require approximately twice the emission area of the collector. For example, for a 10,000 person space colony growing its own food, the waste heat which would be accumulated would require a radiator of approximately a square kilometer.

Conventional radiators operate best at extremely high temperatures. Other basic problems with conventional radiators are: excessive size, dis-economics of scale, limited maximum velocity of fluid flow.

Large single phase non-condensing radiators in which the fluid mass is dominant has the additional problem that the piping system usually has more mass than the radiator itself.

Different methods have been suggested as means of moving heat from one area to another, the use of heat pumps for example. However, because of power requirements and mass limitations heat pumps appear unpractical at present.

Another suggested method for gas or liquid heat transfer is the use of fluids under pressure that are circulated to move heat from concentrated sources to large radiator surfaces. However, leaks and loss of the heat transfer fluid in such systems would have serious economic consequences for their use in the microgravity environment of space because of the high cost of bringing replacement fluid from the earth. The cost of heat transfer apparatus could be significantly reduced if extraterrestrial resources used in their construction could be substituted for earth derived resources.

A serious problem in extraterrestrial resouces utilization is the lack of an obvious heat transfer fluid that is easy to obtain from extraterrestrial materials. Since the moon is the closest extraterrestrial body, presumably these materials should be obtained from it. The only fluid known to be available in quantity from lunar materials is oxygen. Use of oxygen as a heat transfer fluid in a space habitat radiator has already been explored. The amont of heat a gas stream can carry away is proportional to the mass of the gas, and reasonable mass flows require fairly high pressure (a substantial fraction of an atmosphere). Such high pressure systems would necessitate relatively thick radiator walls and even then, micrometeroide punctures would complicate the problem of high gas leak losses.

The ideal heat transfer medium for use in space would have a high specific heat, very low vapor pressure, and low viscosity to minimize pumping losses. Moreover, the heat transfer medium should not freeze. In addition it would be convenient if this medium could be made available with minimal processing from lunar materials.

SUMMARY OF THE INVENTION

If a low pressure gas, at on the order of 0.1% to 10% of the earth's sea level atmospheric pressure, is used to move finely divided solids over a heat transfer surface, great amounts of heat could be carried at little or no cost in structural mass. Solids used in such a multiphase heterodensity medium may be finely ground lunar soil or slag from processing operations. Obvious problems such as abrasive wear can be minimized by controlling the size and shape of the solids; by using rubber covered surfaces for pumps and fans; by avoiding sharp bends in the manifolds; by fitting hardened or replaceable parts where necessary; and by keeping the flow rates low, i.e. below a few tens of meters per second.

The closest earth-based industrial experience to multiphase heterodensity fluids are fluidized beds. Fluidized beds (one naturally occurring fluidized bed is known as quicksand) are used for heat treating, combustion, and chemical reactor while most of the cement, flour and other bulk substances in this country are loaded and unloaded from shipping containers by pneumatic conveyance and pneumatic transport.

On earth, gas entrained solids require substantial energy to keep the sand or other solids suspended against the effects of gravity. This requires high flow rates and gas phase pressures. In a zero or microgravity environment of a space habitat or space power supply radiator, however, no energy beyond the energy required for circulation is needed to keep the solid phase well mixed with the gas.

In addition, the radiator would be designed such as to maximize radiation qualities utilizing minimum amounts of materials.

The inventon described herein is a method and apparatus for dissipating large amounts of heat in a space environment, i.e. in microgravity. Finely powdered dust is mixed with gas to form a multiphase heterodensity heat transfer medium. Heat is transferred to the heterodensity medium by a conventional heat exchanger, for example where water or other fluid at a high temperature from a source of the heat enters the heat exchanger, and transfers heat to a surrounding gas-dust particle heterodensity heat transfer medium, whereupon the water or fluid exits the heat exchanger to return to the primary source of heat. The present invention may also operate with its heterodensity medium in direct thermal contact with the primary source of waste heat.

The heated solids and gas in the heterodensity medium are at a relatively low pressure, i.e. on the order of 0.1% to 10% of the earth's atmosphere pressure and are moved by a blower, for example a centrifugal or axial fan, to a large emission type radiator, where the heat in the heterodensity heat transfer fluid is transferred to the sides of said radiator, and then radiated out into space. The gas-dust mixture is then returned to the first mentioned conventional type heat exchanger where the process is repeated.

Accordingly, it is an object of the subject invention to devise a radiator for use in a microgravity environment utilizing a multiphase heterodensity heat transfer fluid to transfer and radiate waste heat.

It is an additional object of the subject invention to utilize a gas-dust mixture as a heat transfer fluid in a waste heat radiator system.

It is still a further object of the subject invention to devise a gas-entrained solids space radiator utilizing gas at low pressure.

It is an even further object of the present invention to propell gas-entrained solids through a space type radiator in such a manner as to minimize wear on the piping system.

The above and other objects of the described invention will be obvious to those skilled in the art from the remainder of this specification.

DETAILED DESCRIPTION OF THE PREFERRED EMBODIMENT

Figure 1:
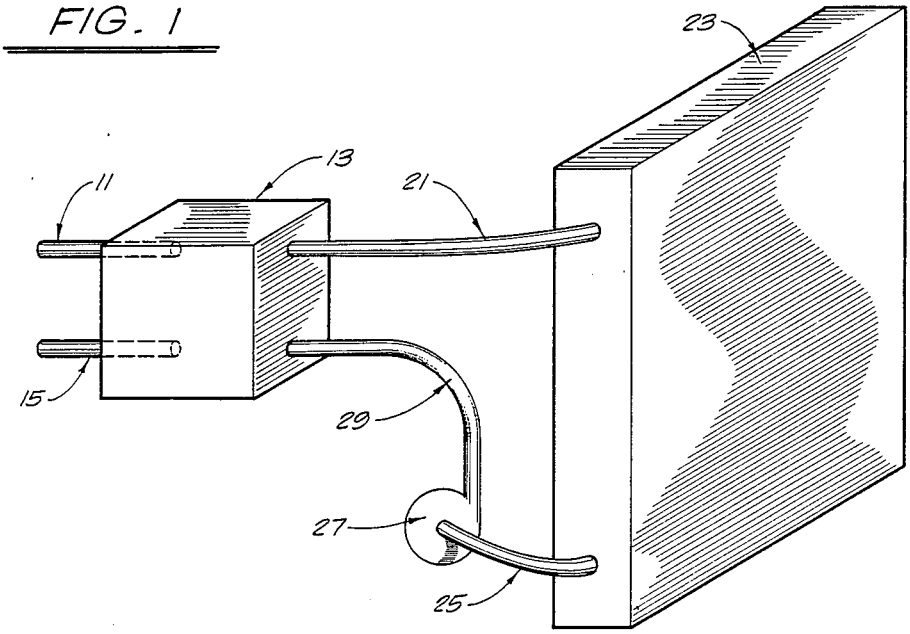
FIG. 1 is a perspective schematic block diagram of the subject invention.

Referring now to FIG. 1, a perspective view of a schematic block diagram of the present invention is detailed, showing, beginning at the left, the input hot water or other fluid line 11 from the primary heat source into the conventional heat exchanger 13, and the resulting cold water or other fluid outlet line 15, the cold water line being an extension of the hot water line through heat exchanger 13.

On the other side of heat exchanger 13 is the hot gas-dust fluid heat output line 21 of heat exchanger 13 which connects between heat exchanger 13 and emissive type radiator 23, which receives the hot gas-dust fluid mixture, and through its vast surface, radiates the heat away. The hot gas-dust heat exchange medium is picked up in the lower porton of the radiator 23 as shown in FIG. 1, and through means of cold gas-dust fluid line 25, which is directed to the center portion of centrifugal blower 27, which in turn propels the gas-dust fluid mixture through line 29 back into heat exchanger 13.

A detailed thermodynamic and cost analysis of this invention is given in the July and August, 1979 issues of *L-5 NEWS*, available from the L-5 Society, 1620 North Park Avenue, Tucson, Ariz. 85719. A copy of this detailed analysis is attached to this application and its teachings are incorporated by reference into this application.

Figure 2:
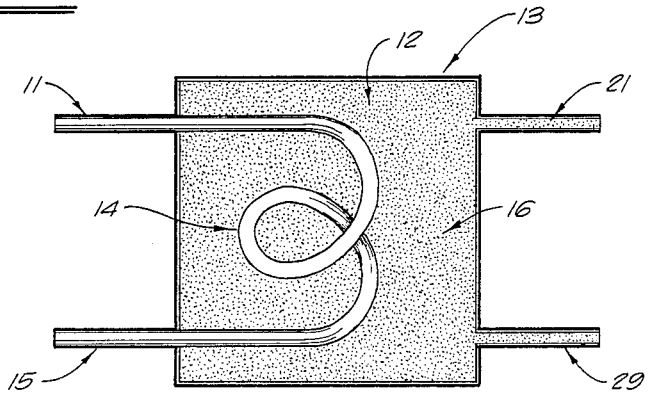
FIG. 2 is a cut-away view of the heat exchanger.

FIG. 2 is a schematic cut-away view of the heat exchanger 13. Coiled line 14 interior to the heat exchanger 13 is connected to hot water line 11 at one end and to the cold water outlet 15 at the other end. Heat exchanger 13 is shown in fluid communication with hot-gas fluid line 21 which, through the use of the low pressure, i.e. 0.001 to less than one atmospheres, gas and the dust particles, removes heat from the center coil 14. Shown in FIG. 2 in greatly exaggerated illustration, are the individual dust particles 12 which are mixed with the gas. Of course the relative density of the particles is much greater than shown.

Although FIG. 2 shows the multiphase herterodensity medium in the interior 16 of heat exchanger 13 in thermal contact with heat exchange coil 14, it is intended by the inventors that this thermal contact may be made by the present invention's novel medium with any source of heat.

Figure 3:
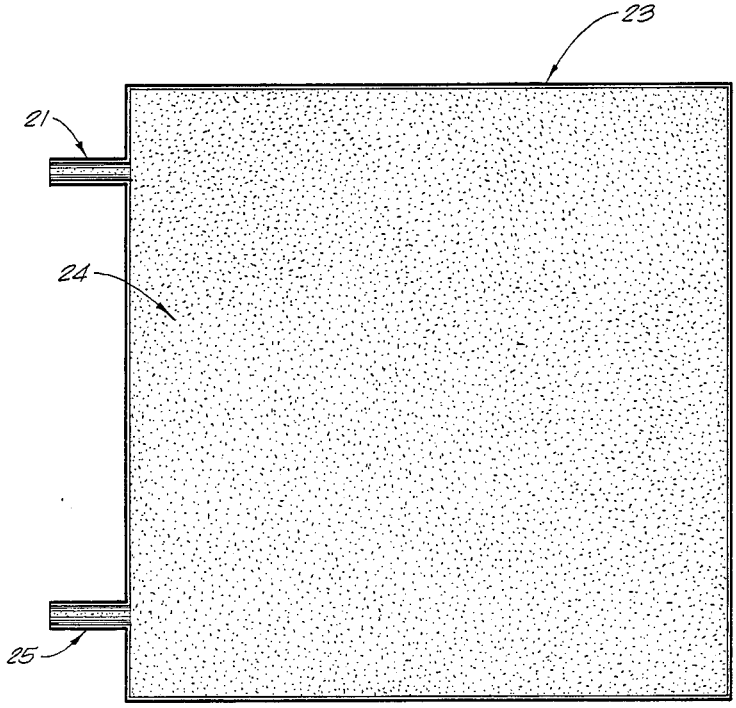
FIG. 3 is a cut-away view of the space emissive radiator.

Referring now to FIG. 3, a cut-away schematic block diagram view of the radiator 23 is shown where illustrated are the particles 24 which are mixed with the gas and which float around interiorly. Again a portion of the particles are shown in great exaggeration as to size, reflecting only a small portion of the idealized density. In the space emissive radiator 23, it is contemplated that the radiation surface area will be very large in comparison to the sides since the radiator works in space to eliminate heat by radiation emission only. Therefore, a maximum surface area is necessary.

In the invention as described, it is anticipated that the radiator will be used in space applications, where the effects of gravity are nil, or in a gravity field of such a small magnitude, on the order of $1\times10^{-3}$ times the earth's gravity. The radiator, to function properly, must have the individual particles suspended in the gas system.

The remaining portion of the invention, i.e. the centrifugal blower 27, is of conventional design and may be any fluid moving apparatus capable of moving the present invention's multiphase (i.e. gas-solid) heterodensity heat transfer medium. As is shown in FIG. 1, blower 27 takes the gas-dust mixture through an input centrally. The dust-gas mixture is then moved, by rotating vanes, and exits the pump with added velocity.

In the preparation of the dust for space application, the preferred embodiment would be ground up lunar soil to pass a 300+ mesh minimum. If the lunar soil were processed, then a metal of high specific heat, i.e. beryllium, might be used. The gas would preferably be hydrogen because of its relatively high heat conductance. In the most expected applications, especially if the materials are gathered from celestial bodies such as the moon, asteroids, or on the surface of moons of other planets, the lunar materials, properly ground up would be the least expensive, and the most readily available gas would be oxygen derived from the lunar materials. Both are suitable for use with the present invention.

The choice of a gas-entrailed solids radiator parameters starts from a determination of the maximum velocity of the gas/solid mix which will not wear away the radiator from the inside. Wear decreases essentially to zero when the particle velocity perpendicular to the wall is low. Wear, therefore, is most likely to occur where the tubes change direction or join headers.

In connection with the expected wear of the parts of the invention, the wear rate of the metal parts will be determined primarily by the velocity of the particles, the hardness of the particles, and container surfaces, as well as the angle in which the particles impinge the sides of the metal containers, namely the heat exchanger and emissive radiator.

The centrifugal blower which has been mentioned previously, should have, for longest life, rubberized or rubber coated blades since this instrument will be meeting the particles at the greatest velocity that the particles will possess at any one time.

There have been mentioned additional factors which might be harmful in the invention, namely the presence of static electricity; however, this problem may be solved by adding a small amount of finely ground radioactive sources, preferably alpha particle emitters, to the gas-dust mixture. The radioactive sources discharge and drain off the static charge which may reside on the small particles.

Another effect that must be watched for is the tendency of the dust to agglomerate, i.e. where the particles stick together and tend to clog up the passageways and thereby decrease the efficiency of the unit. This is overcome by adding small quantities of compounds such as steric acid.

It is anticipated that the gas pressure which is the only contributing factor in establishing a pressure in the invention will not be of a high value, but that the gas pressure will be relatively small in terms of atmospheric pressure on the earth. The dust particles do not significantly contribute to the gas pressure.

While the preferred embodiment has been shown and described, it would be understood that there is no intent to limit the invention by such disclosure, but rather it is intended to cover all modifications and alternate constructions falling with the spirit and the scope of the invention as defined in the appended claims.

We claim:

1. A heat exchange apparatus comprising:

a first heat exchange means having a hot side and a cold side for bringing a multiphase heterodensity heat exchange medium into thermal contact with a source of heat, whereby heat is transferred from the source of heat to the medium, said first heat exchange means having an interior and an exterior, said multiphase heterodensity heat exchange medium contained in the interior of said first heat exchange means;

a second heat exchange means having a hot side and a cold side for bringing said medium in thermal contact with a heat sink;

pumping means in fluid communication with said first and second heat exchange means for moving said medium from the hot side of said first heat exchange means to the cold side of said second heat exchange means and from the hot side of said second heat exchange means to the cold side of said first heat exchange means; and microgravity means for producing a microgravity environment within said interior of said first heat exchange means, said microgravity means interactive with said interior.

2. An apparatus as in claim 1 wherein, said second heat exchange is a thin walled large plate emission radiator; and said pumping means moves said medium at a velocity low enough to prevent said medium from substantially abrading said first or said second heat exchanges or said pumping means.

3. An apparatus as in claim 1 wherein said pumping means is a centrifugal blower, said medium is at a pressure of from 0.001 bar to 0.1 bar and pumping means moves said medium at a velocity of between 1 and 100 meters/sec.

4. The apparatus of claim 1, said second heat exchange means having an interior and an exterior, said microgravity means for producing a microgravity environment within said interior of said second heat exchange means, said microgravity means interactive with said interior.

5. The apparatus of claim 1, said multiphase heterodensity heat exchange medium comprising:

a first gas phase; and at least one solid phase, said solid phase having a density substantially different from said gas phase, wherein the mass fraction of said solid phase exceeds the mass fraction of said gas phase.

6. The apparatus of claim 4, wherein said first gas phase is at less than one bar of pressure.

7. The apparatus of claim 5, wherein said first gas phase is at an absolute pressure of between 0.001 and 0.1 bar.

8. The apparatus of claim 6, wherein said solid phase is finely divided.

9. The apparatus of claim 7, wherein said solid phase is dust capable of passing a 300 mesh sieve.

10. The apparatus of claim 5, wherein at least a portion of said solid phase emits ionizing radiation.

11. The apparatus of claim 4, wherein at least a portion of said solid phase is derived from extraterrestial materials.

12. The apparatus of claim 4, wherein said gas is oxygen at less than one bar of pressure and said solid phase is finely divided extraterrestial material.

* * * * *